United States Patent [19]

LaBate

[11] Patent Number: 4,468,013

[45] Date of Patent: Aug. 28, 1984

[54] DEVICE FOR PLACING SLAG RETENTION DEVICES IN TAPPING CONVERTERS

[76] Inventor: Micheal D. LaBate, 115 Hazen Ave., Ellwood City, Pa. 16117

[21] Appl. No.: 515,997

[22] Filed: Jul. 22, 1983

[51] Int. Cl.[3] ..... C21C 5/48

[52] U.S. Cl. ..... 266/272; 222/597; 222/602

[58] Field of Search ..... 266/271, 272; 137/172; 222/597, 598, 591, 602, 594

[56] References Cited

U.S. PATENT DOCUMENTS 742,199 10/1903 Lewis et al. ..... 266/272

3,459,209 8/1969 Kobusch et al. ..... 137/172

FOREIGN PATENT DOCUMENTS 386994 9/1973 U.S.S.R. ..... 266/271

505679 6/1976 U.S.S.R. ..... 266/272

*Primary Examiner*—L. Dewayne Rutledge

*Assistant Examiner*—Robert L. McDowell

*Attorney, Agent, or Firm*—Harpman & Harpman

[57] ABSTRACT

Slag retention devices for use in a tapping converter, such as used in the steel industry, are positioned by a device incorporating a frame attachable to a support in the vicinity of the converter or placed on a movable carriage. The frame, which is movable relative to its support, positions an elongated boom and provides for the longitudinal movement of the boom so that one end of the same carrying a tap hole closure or dart can be positioned thereby through the charging opening of the converter and the closure or dart manipulated by movement of the elongated boom into registry with the tap hole of the converter and forcefully positioned therein.

8 Claims, 6 Drawing Figures

DEVICE FOR PLACING SLAG RETENTION DEVICES IN TAPPING CONVERTERS

BACKGROUND OF THE INVENTION

1. Technical Field

This invention relates to a device for accurately and forefully positioning a slag retaining closure or dart in a tapping converter during the tapping of steel therefrom.

2. Description of the Prior Art

Prior structures of this type are best represented by the disclosure of U.S. Pat. No. 3,459,209 in which a closure having a specific gravity lower than that of the steel produced in the converter but higher than that of the slag on the molten steel is positioned in the converter by a tube which at one end thereof releasably supports the closure.

The present invention utilizes the equivalent of the tube of the prior art patent and provides a device for manipulating the boom enabling it to more efficiently move the closure or dart into the charging opening of the converter and then forcefully position it in the tap hole thereof.

SUMMARY OF THE INVENTION

A device for placing slag retention devices in tapping converters includes a vertically arranged frame structure that may be swingably mounted on vertical supports adjacent a converter or a furnace or alternately upon a movable carriage and incorporates mechanisms supporting an elongated boom in a tiltable, revolvable and extensible manner so that a tap hole closure or dart incorporating an elongated guide may be temporarily attached to one end of the elongated boom and moved by the device into the charging opening of a converter and manipulated to position the closure or dart in the tap hole thereof.

DESCRIPTION OF THE PREFERRED EMBODIMENT

Figure 1:
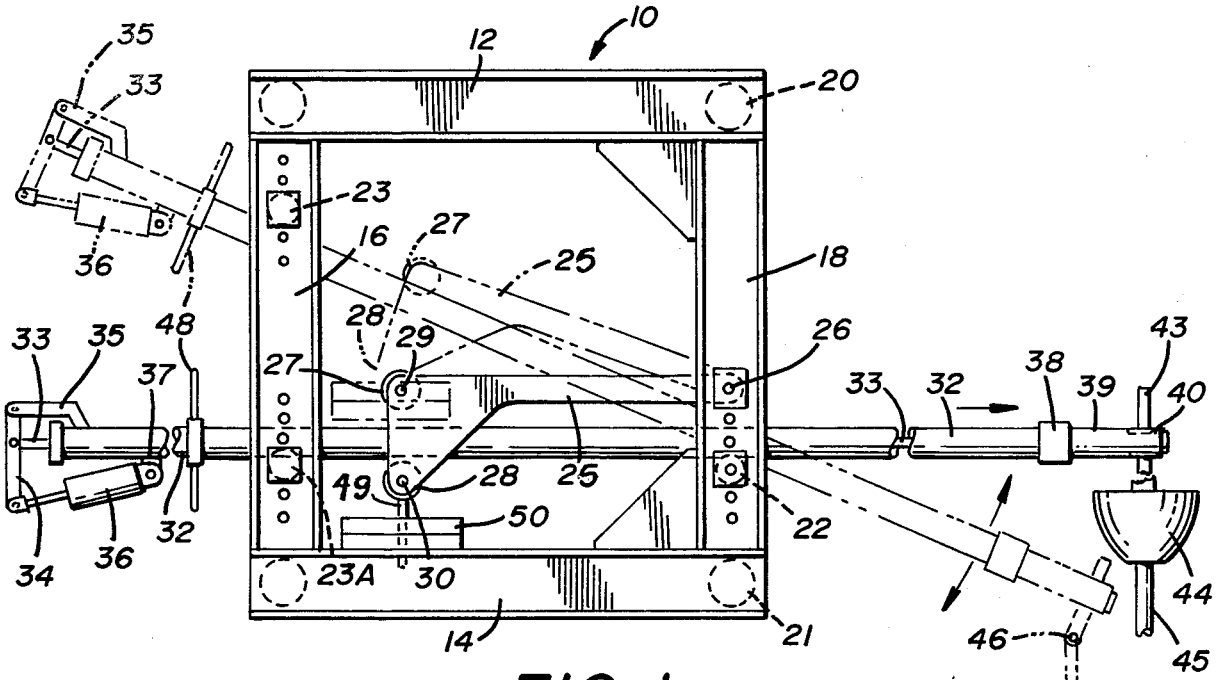
FIG. 1 is a side elevation of the device with parts in broken lines indicating an alternate position of a portion thereof.
Figure 2:
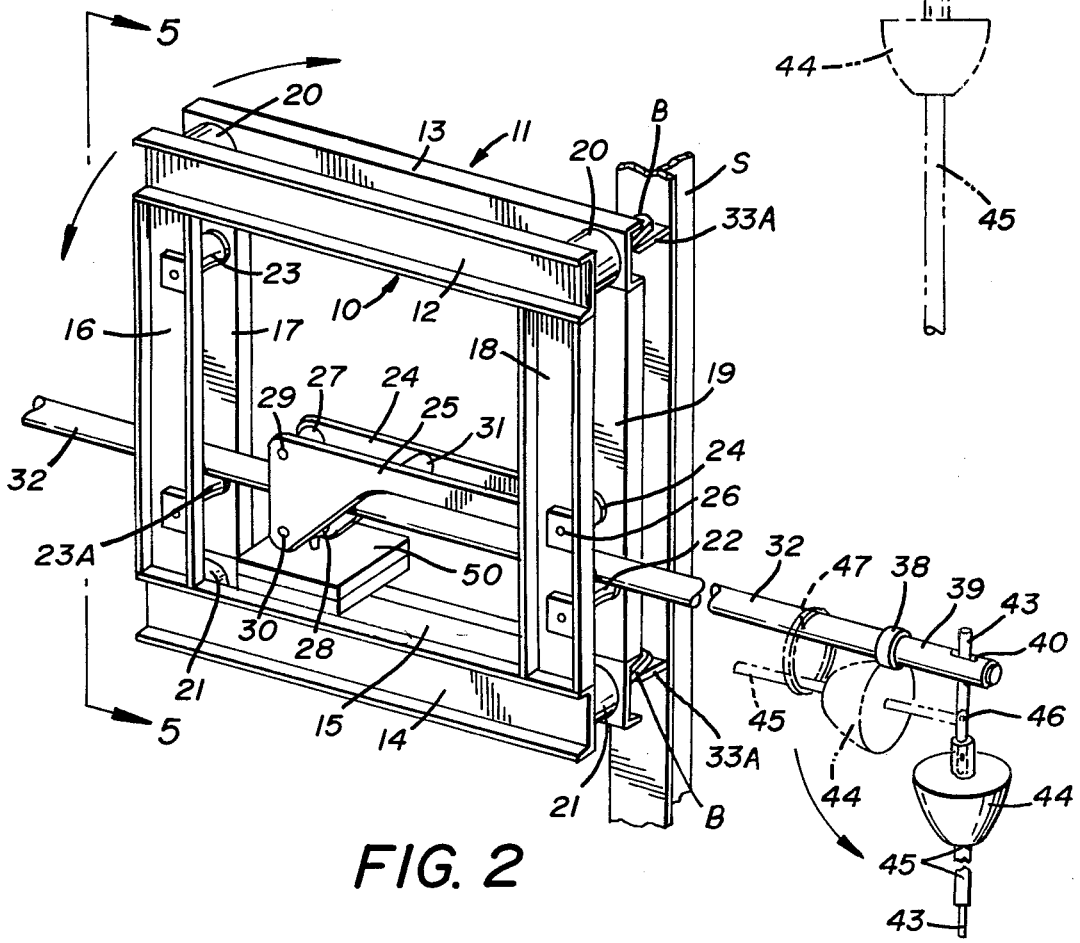
FIG. 2 is a perspective elevation of the device showing the same mounted for swinging motion relative to a vertical support adjacent a converter.
Figure 5:
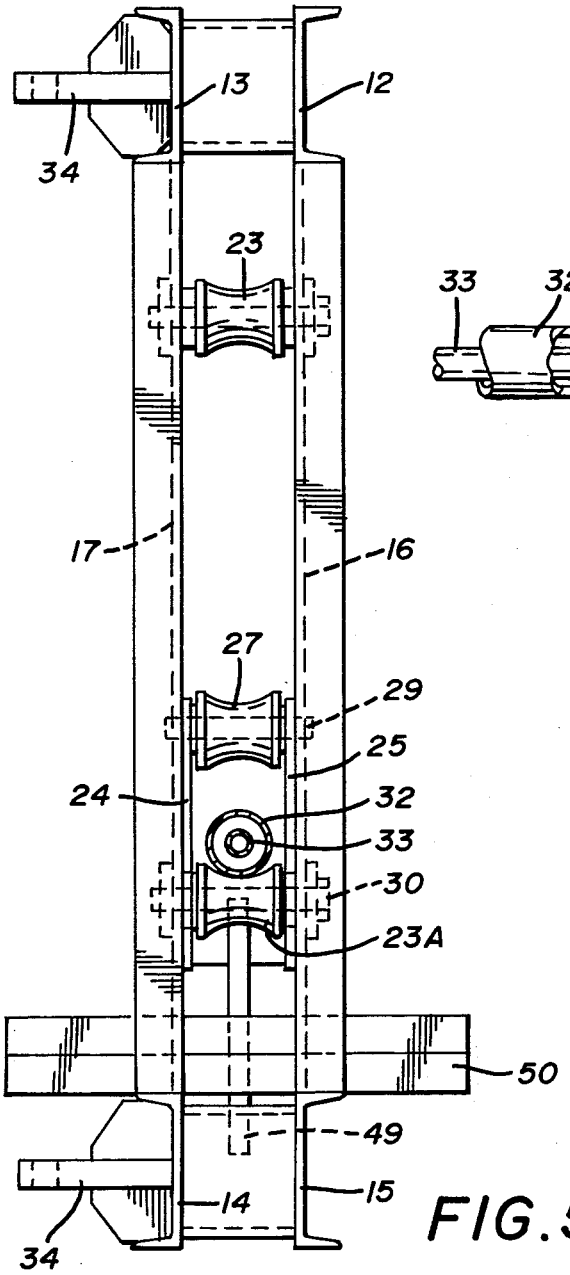
FIG. 5 is an end elevation of the invention shown in FIG. 1 of the drawings.

The device for positioning slag retaining devices, such as darts, in tapping converters as used in the steel industry is illustrated in its simplest form in FIGS. 1, 2 and 5 of the drawings and by referring to FIGS. 1 and 2, it will be seen that the device comprises a vertically disposed frame which is formed of a pair of substantially square frames 10 and 11. Each of the sqaure frames 10 and 11 is formed of a pair of upper horizontal channels 12 and 13 and a pair of lower horizontal channels 14 and 15, the respective ends of which are joined by a pair of vertical channels 16 and 17 forming the vertical back portion of the frame and by a pair of vertical channels 18 and 19 forming the front portion of the vertical frame of the device. The frames 10 and 11 are spaced with respect to one another by upper members 20 and lower members 21. A shaped roller 22 is positioned between the front vertical channels 18 and 19 near their lower ends and a pair of shaped rollers 23 and 23A are positioned in vertically spaced relation between the back vertical channels 16 and 17. A pair of spaced arms 24 and 25 are pivoted at their forward ends between the front vertical channels 18 and 19 by means of a horizontal pivot 26 and a pair of shaped rollers 27 and 28 are rotatably mounted between the opposite ends of the arms 24 and 25 by pivot pins 29 and 30. A spacer 31 is positioned between the arms 24 and 25. The shaped rollers 27 and 28 are spaced apart sufficiently to movably receive an elongated hollow boom 32 which in the position shown in solid lines in FIGS. 1 and 2 also rests on the shaped roller 23 A at the back of the frame and the shaped roller 22 at the front of the frame.

In FIG. 2 of the drawings, a vertical structural member S is shown broken away from its attachment to the floor and structure of the building in which the device is used and adjacent the converter.

In FIG. 2 of the drawings, support brackets 33A on the vertical support S pivotally engage oppositely disposed apertured brackets 34B on the upper and lower horizontal channels 13 and 15 of the vertical frame 11. The vertical frame is therefore swingably mounted with respect to the vertical structural support S.

By referring now to FIG. 1 of the drawings, it will be seen that the elongated hollow boom 32 has an elongated tubular member 33 positioned therein with one end of the member 33 extending outwardly of the left end of the elongated boom 32 where it is pivotally connected to a lever 34 which in turn is pivotally attached to a bracket 35 on the boom 32 and to the piston rod of a piston and cylinder assembly 36 which is pivoted to the boom 32 by way of a bracket 37. The arrangement is such that actuation of the piston and cylinder assembly 36 will impart movement to the lever 34 and comparable longitudinal movement to the elongated tubular member 33.

Figure 6:
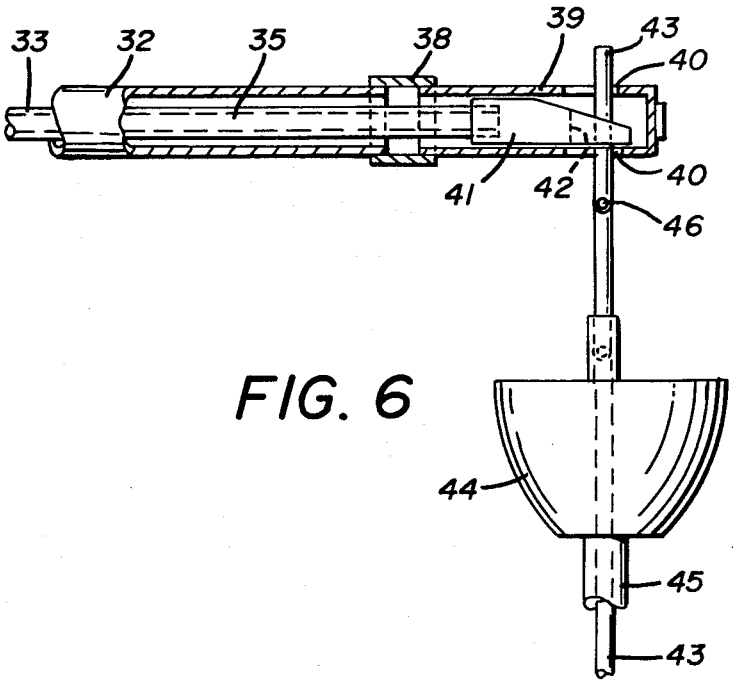
FIG. 6 is an enlarged detailed side elevation of a portion of the boom seen in FIGS. 1,2 and 3 of the drawings with parts broken away and parts in cross section.

Referring to FIGS. 1 and 6 of the drawings, the opposite end of the boom 32 may be seen and in FIG. 6, which shows the same in cross section, the end of the boom 32 will be seen to be provided with a coupling 38 which mounts a tubular extension 39 which is provided with upper and lower elongated slots 40. A tapered body member 41 provided with a vertically arranged slot 42 is slidably disposed in the tubular extension 39 and attached to the end of the elongated tubular member 33. A rod 43 positioned through the slots 40 and 42 may thus be held in fixed relation to the end of the boom 32 by movement of the tapered body member 41 as occasioned by action imparted by the piston and cylinder assembly 36 heretofore referred to. The slotted tubular extension 39 in which the slotted tapered body member 41 is movably disposed comprise jaw formations.

The piston and cylinder assembly 36 is preferably pneumatically actuated from a compressed air source with suitable valves, not shown.

The rod 43 is part of a tap hole closure which includes a modified conical body 44 through which the rod 43 extends axially and from the lower or underside of which the rod 43 continues downwardly a suitable distance. Refractory sleeves 45 are positioned around the lower portion of the rod 43 and this portion of the tap hole closure forms a guide which is manipulated into engagement with the tap hole in the furnace or converter after the closure, often called a dart, is positioned in the furnace or converter through the charging opening thereof as will be understood by those skilled in the art.

Referring again to FIG. 2 of the drawings, it will be seen that the rod 43 is provided with a pivot or swivel mechanism 46 so that the closure or dart semi-conical body 44 and the depending rod 43 and refractory sleeves 45 may be positioned in substantially parallel relation to the boom 32 and temporarily held in such position by a releasable band 47.

It will occur to those skilled in the art that this arrangement permits the closure or dart held by the end of the elongated boom 32 to be moved into the charging opening of the furnace or converter whereupon freeing the band 47 will permit the closure or dart to swing downwardly to a substantially vertical position. The positioning of the closure or dart including the semi-conical body 44 is achieved by manually moving the elongated boom 32 relative to the rollers 22, 27 and 28 as heretofore described while the elongated boom 32 is in substantially horizontal position for alignment with the charging opening of the furnace or converter. When the closure or dart including the semi-conical body 44 is in substantial vertical alignment with the tap hole in the furnace or converter, the elongated boom 32 may be rotated on its axis by a hand wheel 48 as seen in FIG. 1 of the drawings to cause side to side motion of the rod 43 and the modified conical body 44 of the closure or dart. When the same is in substantial alignment with the tap hole as may be determined by the partial engagement of the rod 43 and its refractory sleeves 45, the opposite end of the elongated boom 32, the left end as seen in FIG. 1 of the drawings, is elevated manually as permitted by the swinging motion of the arms 24 and 25 to forcefully position the closure or dart and the semi-conical body 44 thereof in sealing relation to the tap hole thus effectively blocking the flow of molten metal and more particular slag therefrom.

The vertical motion of the left hand portion of the elongated boom 32 is limited by the upper shaped roller 23 and the lower shaped roller 23A.

By referring now to FIGS. 1,2 and 5 of the drawings, it will be seen that the free ends of the arms 24 and 25 which carry the shaped rollers 27 and 28 also carry a pivoted vertically disposed arm 49 on which a plurality of counter weights 50 are positioned. The counter weights 50 are arranged to substantially balance the extending portion of the elongated boom 32 as necessary to reach into a furnace or converter through the charging opening thereof as hereinbefore described. If desired the lower shaped roller 28 on the shaft 30 may be eliminated and the vertical support 49 carrying the weights 50 attached to the shaft 30 in place thereof. In such event, the shaped roller 27 remains and will effectively control the engagement of the arms 24 and 25 therewith as occasioned by the counterweights 50.

Figure 3:
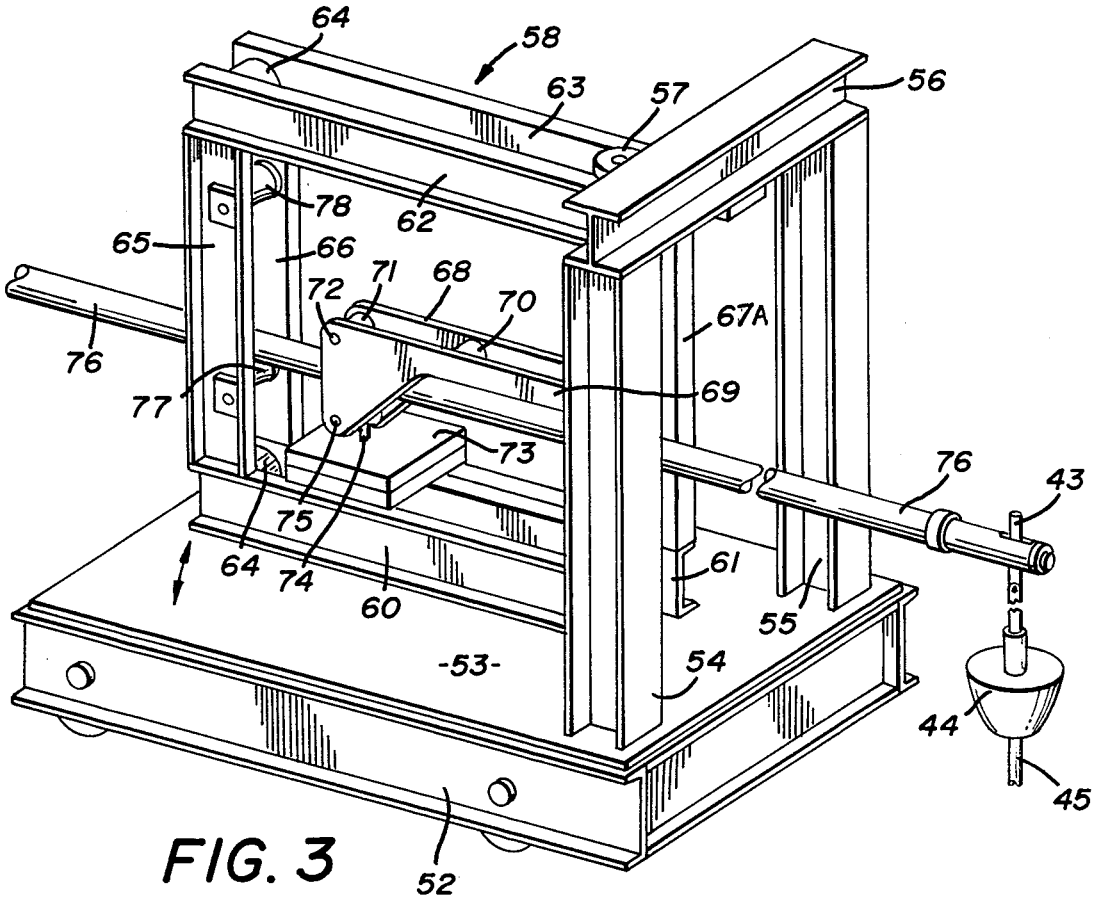
FIG. 3 is a perspective view of a modified form of the invention mounted on a movable carriage.
Figure 4:
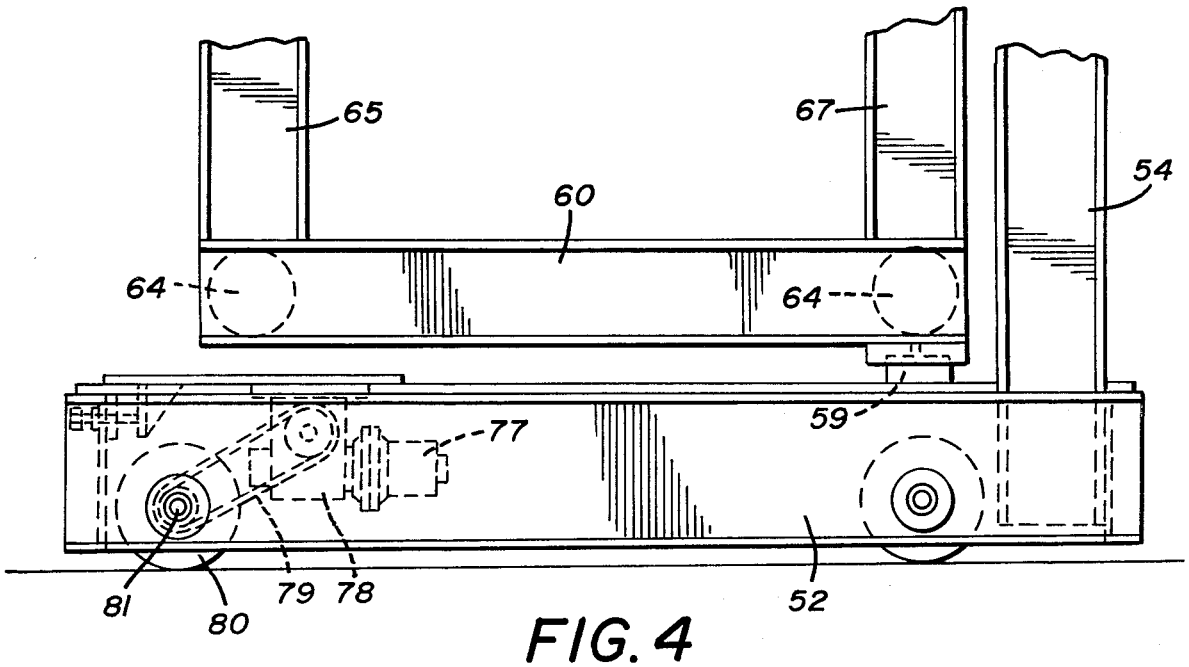
FIG. 4 is an enlarged detail of a portion of the carriage and the modified device of FIG. 3.

By referring now to FIGS. 3 and 4 of the drawings, an alternate form of the invention may be seen in which the essential mechanism of the device hereinbefore described remains the same, but the mounting frame thereof differs.

In FIGS. 3 and 4 of the drawings a wheeled carriage 52 has a flat upper surface 53 on which a pair of horizontally spaced vertical supports 54 and 55 are positioned adjacent one end thereof. The vertical supports 54 and 55 are joined at their upper ends by a cross frame member 56 and a bracket 57 extends outwardly from the cross frame member 56 toward the opposite end of the wheeled carriage 52 and provides a pivot support for a vertical frame generally indicated at 58. A second pivot support 59 is positioned in vertical alignment below the pivot support 57 so that the vertical frame generally shown at 58 can swing on the axis of the pivot supports 57 and 59. The vertical frame 58, like that hereinbefore described in connection with FIGS. 1,2 and 5 of the drawings, comprises spaced lower channel members 60 and 61 and spaced upper channels 62 and 63 respectively. These are joined at their opposite ends by spacers 64 and have spaced pairs of vertically arranged channels 65 and 66 at their rearmost end, the left end in FIGS. 3 and 4 of the drawings and spaced vertical channels 67 and 67A at their foremost end, the right end of the frame 58 in FIGS. 3 and 4 of the drawings. A pair of arms 68 and 69 are pivoted at their forward (right) ends between the forward vertical frame members 67 and 67A and are held in spaced relation by a spacer 70. A shaped roller 71 is mounted on a shaft 72 adjacent the free ends of the arms 68 and 69 and a counter weight 73 is suspended from a pivot member 74 engaging a shaft 75 extending between the arms 68 and 69. An elongated boom 76 comprising a duplicate of the elongated boom 32 hereinbefore described is positioned between the depending portion of the arms 68 and 69 for engagement beneath the shaped roller 71 and its vertical travel is controlled by shaped rollers 77 and 78 which are rotatably mounted on shafts extending between the rear vertical support frames 65 and 66 as hereinbefore described. The forward or right end of the elongated boom 76 is provided with the same sort of coupling and tubular extension and rod engaging devices as hereinbefore described in connection with FIG. 6 of the drawings so that a rod 43 on a tap hole closure having a modified conical body 44 and a depending refractory guide 45 may be detachably secured thereto.

By referring now to FIG. 4 of the drawings in particular, it will be seen that the wheeled carriage 52 is preferably provided with a drive mechanism including a source of rotary motion such as an air motor 77 coupled to a transmission 78 which in turn is connected by drive trains 79 to a pair of wheels 80 on an axle 81.

It will thus be seen that the device for placing slag retention devices in tapping converters or furnaces as described in detail in connection with FIGS. 1,2, 5 and 6 of the drawings is also usable as shown in FIGS. 3 and 4 of the drawings in connection with a wheeled carriage and an upright support frame which pivotally mounts the main vertical frame of the device of the invention.

Although but two embodiments of the present invention have been illustrated and described, it will be apparent to those skilled in the art that various changes and modifications may be made therein without departing from the spirit of the invention and having thus described my invention what I claim is:

1. A device for placing slag retaining devices in tapping converters and furnaces comprising a vertically disposed framework and an elongated boom movable with respect to said framework, means in said framework limiting the vertical motion of a substantially middle portion of said elongated boom and forming a fulcrum for said boom, secondary means in said vertical framework limiting the vertical movement of said elongated boom, said secondary means spaced horizontally with respect to said first mentioned means, at least one arm pivoted to said vertical framework adjacent said first guide means and extending toward said secondary guide means and third guide means on the free end of said arm for engaging said elongated boom and a counterweight attached to the free end of said arm for balancing said elongated boom over said fulcrum, means for rotating said elongated boom on its axis, an elongated member in said elongated boom and movable in coplanar relation thereto and means on said elongated boom for imparting axial motion to said elongated member, jaw formations on one end of said elongated boom and said elongated member for detachably engaging an object carried thereby into said tapping converter and means mounting said vertically disposed framework for swingable motion relative to a fixed vertical support.

2. The device for placing slag retaining devices in tapping converters set forth in claim 1 and wherein said means in said framework limiting the vertical motion of a substantially middle portion of said elongated boom and forming a fulcrum for said boom comprises a pair of vertically spaced pivot members on said vertically disposed framework, shaped rollers on said pivot members, said pivot members and shaped rollers positioned in horizontally spaced relation to said arm and said third guide means thereon.

3. The device for placing slag retaining devices in tapping converters set forth in claim 1 and wherein said secondary means in said vertical framework limiting the vertical movement of said elongated boom comprise vertically spaced pivot members on said vertically disposed framework, shaped rollers on said pivot members, said pivot members and shaped members forming said secondary means being positioned on said vertically disposed framework and spaced horizontally from said means limiting the vertical motion of the substantially middle portion of said elongated boom.

4. The device for placing slag retaining devices in tapping converters set forth in claim 1 and wherein said means for rotating said elongated boom on its axis comprises a wheel affixed to said elongated boom in outwardly spaced relation with respect to said vertically disposed framework.

5. The device for placing slag retaining devices in tapping converters set forth in claim 1 and wherein said means on said elongated boom for imparting axial motion to said elongated member comprises a piston and cylinder assembly pivoted to said boom, at least one lever engaging said elongated member, said piston and cylinder assembly connected to said lever for imparting movement thereto and to said elongated member.

6. The device for placing slag retaining devices in tapping converters set forth in claim 1 and wherein said jaw formations on one end of said elongated boom and on said elongated member comprise elongated slots in oppositely disposed relation in said elongated boom and a member slidably disposed in said elongated boom between said elongated slots and having a secondary elongated slot therein arranged for movement into and out of registry with said first mentioned elongated slots.

7. The device for placing slag retaining devices in tapping converters set forth in claim 1 and wherein said means mounting said vertically disposed framework for swingable motion comprise pivot brackets affixed to said vertically disposed framework adjacent one end thereof and extending outwardly therefrom and at least one vertical support having vertically spaced pivot supports thereon for pivotal engagement with said pivot brackets on said vertical frame.

8. The device for placing slag retaining devices in tapping converters set forth in claim 1 and wherein said means mounting said vertically disposed framework for swingable motion comprise pivot brackets affixed to said vertically disposed framework adjacent one end thereof and extending outwardly therefrom and at least one vertical support having vertically spaced pivot supports thereon for pivotal engagement with said pivot brackets on said vertical frame, and a movable carriage of a size comparable with said vertically disposed framework and having a horizontal area, said vertical support mounted on said horizontal area of said carriage.

* * * * *